US007219987B1

(12) United States Patent
Holland et al.

(10) Patent No.: US 7,219,987 B1
(45) Date of Patent: May 22, 2007

(54) TUBE COUPLING FOR INK JET CARTRIDGES

(75) Inventors: Carl W. Holland, Webster, NY (US); William A. Putman, Franklin, TN (US)

(73) Assignee: Nu-kote International, Inc., Franklin, TN (US)

( * ) Notice: Subject to any disclaimer, the term of this patent is extended or adjusted under 35 U.S.C. 154(b) by 300 days.

(21) Appl. No.: 10/916,327

(22) Filed: Aug. 12, 2004

(51) Int. Cl.
*B41J 2/175* (2006.01)

(52) U.S. Cl. ..... 347/87; 347/86

(58) Field of Classification Search ..... 347/86–87
See application file for complete search history.

(56) References Cited

U.S. PATENT DOCUMENTS 5,367,328 A * 11/1994 Erickson ..... 347/7
5,469,201 A 11/1995 Erickson et al.
5,745,137 A 4/1998 Scheffelin et al.
5,900,896 A * 5/1999 Barinaga et al. ..... 347/86
6,000,791 A * 12/1999 Scheffelin et al. ..... 347/87
6,003,984 A * 12/1999 Bohorquez et al. ..... 347/86
6,511,165 B1 * 1/2003 Barinaga et al. ..... 347/85

* cited by examiner

*Primary Examiner*—Stephen Meier
*Assistant Examiner*—Han Samuel Choi
(74) *Attorney, Agent, or Firm*—Fay Sharpe LLP

(57) ABSTRACT

An ink jet cartridge comprising an outer housing and an inner ink chamber has adjacent housing and chamber wall portions, and a coupling member for communicating the ink chamber with an external source of ink has an inner end extending through an oversized opening in the housing wall portion and into threaded interengagement with an opening through the chamber wall portion. The outer end of the coupling is outside the housing wall portion for connection to a source of ink.

16 Claims, 1 Drawing Sheet

TUBE COUPLING FOR INK JET CARTRIDGES

BACKGROUND OF THE INVENTION

This invention relates to the art of ink cartridges for ink jet printers and, more particularly, to an improved coupling device for connecting an ink supply line to an ink cartridge in a continuous ink supply system.

Continuous ink refill systems for disposable ink jet cartridges are of course well known as shown, for example, in U.S. Pat. No. 5,469,201 to Erickson, et al. and U.S. Pat. No. 5,745,137 to Scheffelin, et al., both of which are incorporated herein by reference for background information. In such systems, basically, a cartridge is connected to an auxiliary ink supply reservoir by means of a flexible hose or tube, and during operation of the printing system, the tube is open to allow ink to flow from the auxiliary reservoir to the ink cartridge. During shipment or handling of the ink supply reservoir/cartridge system when it is outside the print machine, it is important that the connection of the tube to the cartridge be leak tight to preclude the leakage of ink within the cartridge assembly and/or onto exterior surfaces of the cartridge and any box or container in which the ink supply reservoir system is packaged for transportation and storage. Moreover, after installation in the printer, cleaning of the latter and/or the ink delivery system requires removal of the cartridge from the printer, whereby the orientation of the cartridge may change from its upright position in the printer to an inclined or prone position relative to an underlying support surface. Accordingly, it is again essential to have a leakproof connection between the tubing and cartridge to avoid leakage of ink therefrom.

Prior efforts to seal the connection between the supply tubing and cartridge include extending the tube into the cartridge through an opening in an outer wall of the cartridge and gluing the tube in the opening to provide a seal and strain relief for the tubing, as shown for example in the aforementioned patent to Erickson. In the patent to Scheffelin, et al., tubing is coupled to a cartridge through the handle thereof by means of slidably interengaging tubular components which provide a seal against leakage of ink from the cartridge. In the latter arrangement, it is possible to unintentionally separate the coupling components so as to expose ink in the cartridge to spillage. Moreover, at least upon continued usage, wear of the slidably interengaging components could result in creating a leakage path or paths from the interior to the exterior of the cartridge. A coupling of the ink supply tube to an opening into the cartridge by gluing the tubing in place is of course subject to the creation of a leakage path across the glue in response to lateral flexure of the supply tube relative to the cartridge and/or as a result of tension applied to the tubing in the direction outwardly or inwardly of the cartridge.

SUMMARY OF THE INVENTION

In accordance with the present invention, a coupling is provided for connecting flexible ink supply tubing to an ink cartridge which optimizes achieving a leak-tight connection between the cartridge and coupling. The coupling has threaded interengagement with a wall component of the ink chamber in a cartridge such that the interengaging threads are in tension to optimize sealing engagement therebetween and, accordingly, a leak-tight joint between the ink chamber and the exterior of the cartridge. Preferably, the coupling component is provided with a flange adjacent a threaded stem of the coupling which engages the outer side of the wall component of the ink chamber to provide a further seal against leakage as the threaded interengagement between the stem and wall pulls the flange into tight engagement with the outer side of the wall. It is also preferred to provide for the coupling to have an outer leg parallel to the outer side of the cartridge for connection with the supply tubing. This configuration advantageously provides for the tubing to be closely adjacent the outer side of the cartridge and positioned for connection with the cartridge or an attachment thereto to provide strain relief for the tubing.

BRIEF DESCRIPTION OF THE DRAWINGS

The foregoing features of the present invention, and others, will in part be obvious and in part pointed out more fully hereinafter in conjunction with the written description of a preferred embodiment shown in the accompanying drawings in which.

DESCRIPTION OF A PREFERRED EMBODIMENT

Figure 1:
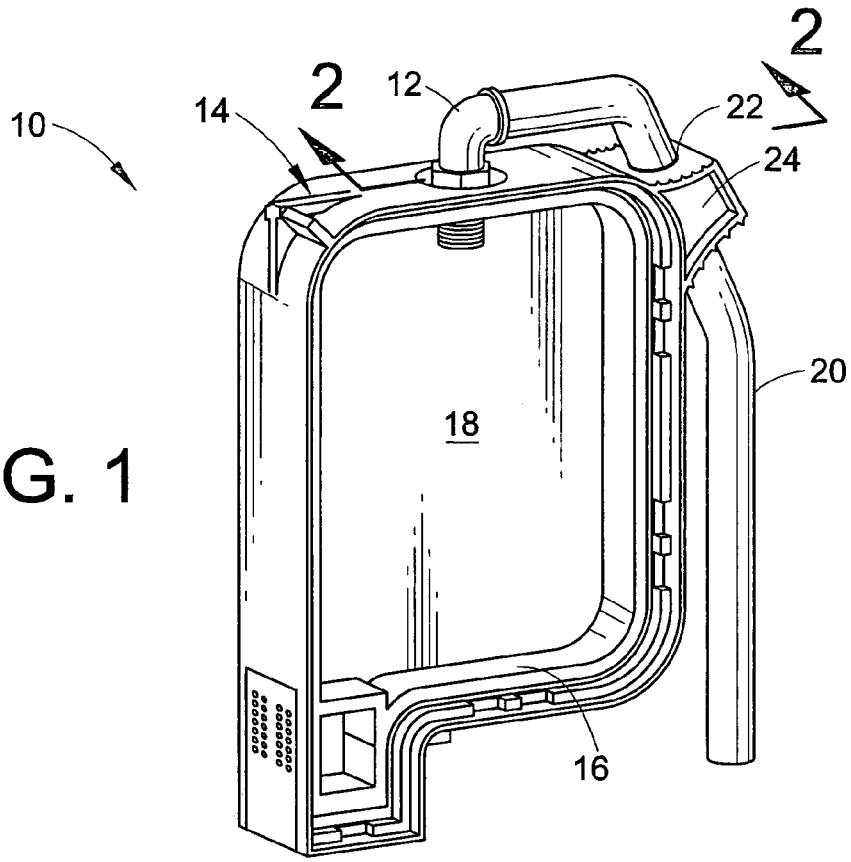
FIG. 1 is a perspective view of the frame components of an ink cartridge having a supply tubing coupling in accordance with the invention mounted thereon; and, FIG. 2 is a sectional elevation view of a portion of the frame components and coupling taken along Line 2—2 in FIG. 1.

Referring now in greater detail to the drawings, wherein the showings are for the purpose of illustrating a preferred embodiment of the invention only and not for the purpose of limiting the invention, FIG. 1 illustrates, in part, an ink cartridge 10 on which a tubing coupling 12 according to the invention is mounted. Cartridge 10 comprises an outer plastic housing 14 and an inner plastic frame 16. While not shown, sheets of foil are attached to the opposite edges of the inner plastic frame to create a bag-like assembly that holds the cartridge ink, and the latter assembly is received within the outer plastic housing but is not attached thereto. Further, while not shown, metal side plates are assembled to the outer plastic housing to complete the outer enclosure for the cartridge. The latter ink cartridge construction is well known in the art. As will be appreciated from the cartridge structure, the area within inner frame 16 provides an ink chamber 18, and in a continuous ink supply system for the cartridge ink is delivered from a reservoir through a flexible ink supply line 20 to coupling 12 and thence into chamber 18 through the coupling. Preferably, a strain relief arrangement is provided for tubing 20 and, in the embodiment herein illustrated, such strain relief is achieved by passing the tubing through an opening 22 through handle 24 of the cartridge.

Figure 2:
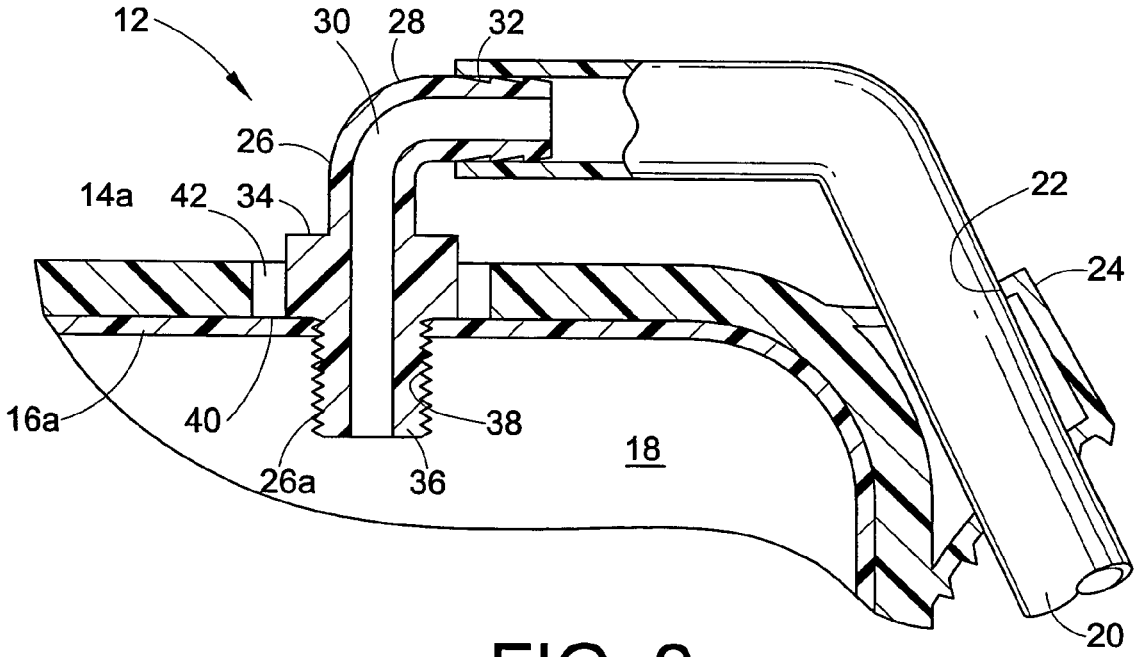

As best seen in FIG. 2, coupling 12 is preferably L-shaped and includes an inner end or first leg 26 connected to upper portion 16*a* of inner frame 16 as set forth hereinafter, and outer end or second leg 28 extending parallel to outer wall portion 14*a* of housing 14. A passageway 30 extends through the coupling for communicating the interior of chamber 18 with supply tube 20. Outer end 28 of the fitting can be provided with any suitable arrangement for attaching tube 20 thereto including, as shown in FIG. 2, serrations 32 which frictionally interengage with tube 20. Other connecting arrangements can be used with or as alternatives to serrations such as, for example, adhesive bonding and clamping devices. Preferably, coupling 12 includes an abutment 34 which, in the preferred embodiment is a radially outwardly extending flange on inner end 26 of the coupling, and the distal end 26*a* of the leg 26 is provided with threads 36 which threadedly interengage with the threads of a threaded opening 38 in wall portion 16*a* of inner frame 16. Flange 34 has a planar inner surface 40 which facially engages against the planar outer surface of wall portion 16*a* and, in accordance with the invention, wall portion 14*a* of outer housing 14 is provided with an opening 42 diametrically larger than the diametric dimension of flange 34, whereby the latter extends freely through opening 42 for the coupling to be attached directly to inner frame 14 of the cartridge. When coupling 12 is mounted on wall portion 16*a* by rotating the coupling to threadedly interengage end 26*a* in opening 38, surface 40 of flange 34 is drawn into sealing interengagement with the outer side of wall portion 16*a* placing threads 36 and the threads of opening 38 in tension, thus optimizing sealing interengagement across the coupling in two areas, namely between surface 40 and wall portion 16*a* and between threads 36 and the threads of opening 38. Distal end 26*a* of leg 26 extends through wall portion 16*a* so as to terminate within ink chamber 18 of the cartridge.

Coupling 12 can be mounted on an existing cartridge by counterboring wall portion 14*a* of outer housing 14 to provide opening 42 therethrough and then drilling and tapping wall portion 16*a* to accept threaded end 26*a* of the coupling member.

While considerable emphasis has been placed herein on the structure of a preferred embodiment of the invention, it will be appreciated that other embodiments as well as changes in the preferred embodiment can be made without departing from the principals of the invention. In particular in this respect, it will be appreciated that outer end 28 of the coupling could be coaxial with inner end 26 as opposed to being at right angles thereto. The latter configuration is preferred in that it provides for supporting the corresponding end of tube 20 close to the top of the cartridge and provide for a convenient intern connection with the cartridge handle to achieve strain relief for the tubing at the coupling. The foregoing and other changes as well as other embodiments of the invention will be suggested and/or obvious to those skilled in the art from the foregoing description, whereby it is to be distinctly understood that the descriptive matter herein is to be interpreted merely as illustrative of the present invention and not as a limitation and that it is intended to include other embodiments and all modifications of the preferred embodiment insofar as they come within the scope of the appended claims or the equivalents thereof.

Having thus described the invention, it is so claimed:

1. An ink jet cartridge comprising an outer housing including a bottom wall, a rear wall, an ink cartridge print head at the juncture between said bottom wall and said rear wall, a top wall including an ink inlet for connection with a flexible ink supply tube, a front wall, a handle at the juncture between said top wall and said front wall, and an inner ink chamber having a plurality of walls separate from walls of said outer housing including a bottom wall, a top wall, a rear wall and a front wall, and a coupling member for communicating the ink chamber with an external source of ink, said coupling member having inner and outer ends, said inner end extending through said housing top wall and being sealingly interconnected with said chamber top wall, and said outer end being outside said housing top wall for connection to said source of ink via said flexible ink supply line.

2. A cartridge according to claim 1, wherein said inner end of said coupling member freely extends through an opening therefor in the housing top wall and sealingly interengages with said chamber top wall.

3. A cartridge according to claim 1, wherein said inner end extends freely through an opening therefor in said housing top wall.

4. A cartridge according to claim 3, wherein said opening is circular.

5. A cartridge according to claim 4, wherein said inner end threadedly interengages with said chamber top wall.

6. A cartridge according to claim 1, wherein said inner end includes an abutment engaging said chambertop wall and a portion inwardly of said abutment extending through and sealingly interengaging with said chamber top wall.

7. A cartridge according to claim 6, wherein said abutment is a flange and said portion inwardly of said abutment includes threads engaging a threaded opening in said chamber top wall and sealing said flange against said chamber top wall.

8. A cartridge according to claim 1, wherein said coupling member is L-shaped.

9. A cartridge according to claim 8, wherein said coupling has first and second legs respectively providing said inner and outer ends.

10. A cartridge according to claim 9, wherein said first leg includes threads threadedly engaging a threaded opening in said chamber top wall.

11. A cartridge according to claim 10, wherein said first leg extends freely through an opening in said housing top wall and includes a radially outwardly extending abutment engaging said chamber top wall to apply a sealing force between said abutment and said chamber top wall and between said threads and said threaded opening.

12. A cartridge according to claim 11, wherein said abutment is a flange on said first leg.

13. A cartridge according to claim 12, wherein said flange is received in said opening in said housing top wall.

14. A cartridge according to claim 13, wherein said second leg is parallel to said housing top wall and facing said handle.

15. A cartridge according to claim 14, wherein said opening has a diametrical dimension and said flange has a diametrical dimension which is less than the diametrical dimension of said opening.

16. A cartridge according to claim 1, wherein said housing further including a strain relief comprising an opening extending through said handle for receiving said supply line.

* * * * *